US005088167A

United States Patent [19]

Rahe

[11] Patent Number: 5,088,167

[45] Date of Patent: Feb. 18, 1992

[54] CREMATION REMAINS HOLDER

[76] Inventor: Gwendolyn A. Rahe, Rt. #1 - Box 135, Jansen, Nebr. 68377

[21] Appl. No.: 637,822

[22] Filed: Jan. 7, 1991

[51] Int. Cl.[5] ..... A61G 17/08

[52] U.S. Cl. ..... 27/1; 99/5

[58] Field of Search ..... 27/1, 8, 19; D99/1, D99/5

[56] References Cited

U.S. PATENT DOCUMENTS

| | | | |
|---|---|---|---|
| D.152,759 | 2/1949 | Warren . | |
| 232,782 | 9/1880 | Townsend | 27/1 |
| D. 248,171 | 6/1978 | Sugarman . | |
| D.268,375 | 3/1983 | Dercks et al. . | |
| 2,009,724 | 7/1935 | Bircher . | |
| 2,513,951 | 7/1950 | McClellen | 27/1 |
| 4,199,848 | 4/1980 | Kohnert . | |
| 4,324,026 | 4/1982 | Craft . | |

*Primary Examiner*—Richard E. Chilcot, Jr.
*Attorney, Agent, or Firm*—Price, Heneveld, Cooper, Dewitt & Litton

[57] ABSTRACT

A cremation remains holder is provided for holding cremated remains and also memorabilia. The holder is in the shape of a miniature casket and includes a hollow portion for receiving cremated remains. A tray sealingly covers the hollow portion and forms a space for receiving memorabilia thereon. A pivotally mounted cover sealingly closes on the hollow portion covering the tray and is held in the closed position by a keyless lock. Optional articles may be added for effect such as lining material, exterior hardware, and the like. In the preferred embodiment, the casket is made to resemble a miniature casket.

14 Claims, 1 Drawing Sheet

CREMATION REMAINS HOLDER

BACKGROUND OF THE INVENTION

The present invention relates to a cremation remains holder, and in particular to one which also holds memorabilia.

Cremation is often used today as an alternative to burial or entombment. However, for some individuals, traditional urns and the like are not satisfactory in appearance and do not offer adequate functional features such as a convenient location for storing memorabilia. Thus, improvements are desired in appearance and in function, and specifically which allow convenient storage of memorabilia along with the cremated remains.

SUMMARY OF THE INVENTION

A cremation remains holder embodying the present invention has the shape of a miniature casket and includes a hollow portion suitable for receiving cremated remains, the hollow portion having a convenient access opening thereto. A tray is sized to fit within the access opening to sealingly close the hollow portion, and positionable in the holder such that memorabilia can be placed thereon. The holder includes means for holding the tray securely in the holder. A cover is shaped to sealingly close on the access opening and over the tray to retain the memorabilia in the holder. The base includes means for securely holding the cover onto the holder.

Other features, advantages and objects of the present invention will be further understood and appreciated by those skilled in the art by reference to the following specification, claims and appended drawings.

DESCRIPTION OF THE PREFERRED EMBODIMENT

Figure 1:
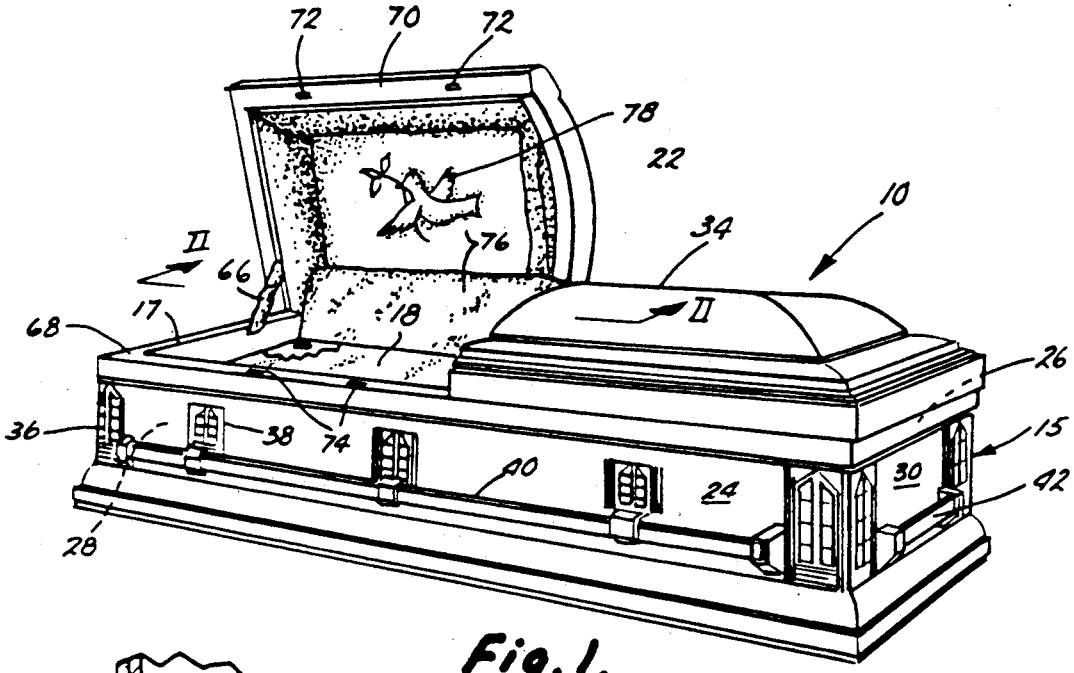
FIG. 1 is a perspective view of a cremation remains holder embodying the present invention.
Figure 3:
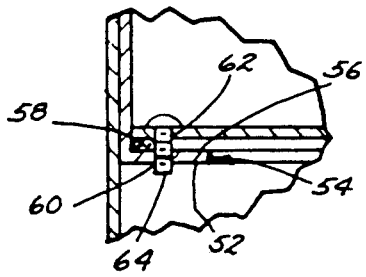
FIG. 3 is an enlarged view of the circled portion labeled as III in FIG. 2.
Figure 2:
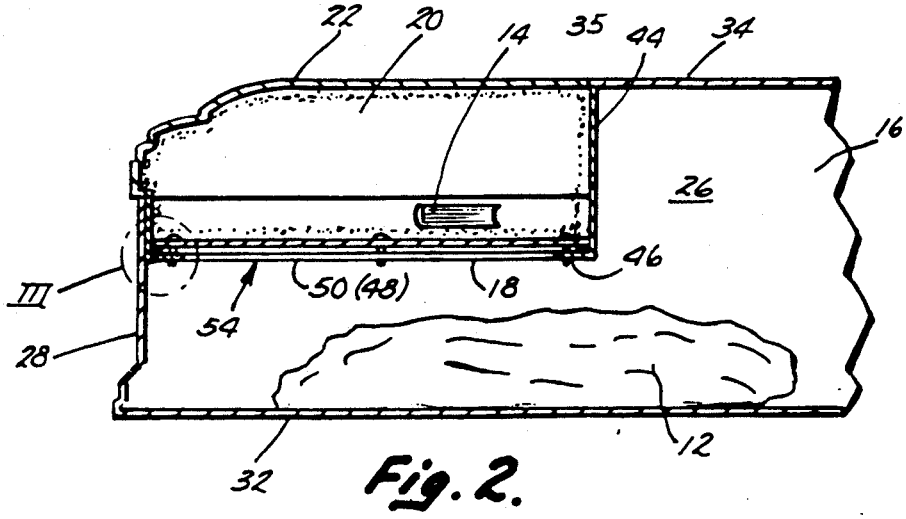
FIG. 2 is a fragmentary cross-section taken through lines II—II in FIG. 1 but with the cover closed.

A cremation remains holder 10 embodying the present invention is provided for holding cremated remains 12 and also memorabilia 14. Holder 10 is generally in the shape of a miniature casket and includes a base 15 having a hollow portion 16 for receiving cremated remains 12 and an access opening 17 thereto. A tray or divider 18 sealingly covers hollow portion 16 and forms a space 20 for receiving memorabilia 14 thereon. A cover 22 sealingly closes on hollow portion 16 and securely retains memorabilia 14 within holder 10.

Base 15 is substantially a boxed like structure having the general shape of a miniature casket. It is contemplated that materials having properties of long life and pleasing appearance such as bronze, stainless steel, or other materials used for caskets or urns can be suitably used. Base 15 is comprised of front and rear sides 24, 26, head and foot ends 28, 30, bottom 32 and partial top 34. Members 24–34 are integrally cast, welded, or otherwise attached to form hollow portion 16 that is suitable for storing cremated remains 12. Members 24–34 can be suitably contoured as desired for aesthetics. Various decor can also be added such as appliques 36, 38 and handles 40, 42.

Partial top 34 extends from foot 30 of base 15 about half-way along the top of base 15. At the forward edge 35 of partial top 34 is a downwardly extending member 44. Member 44 is substantially flat and extends downwardly about ⅓ to ½ of the distance from partial top 34 toward bottom 32. Near the bottom of member 44 is laterally extending ledge 46. Side ledges 48 and 50 and end ledge 52 mounted on sides 24, 26 and end 30, respectively are positioned horizontally parallel to laterally extending ledge 46 and form a continuous ledge 54 suitable for attachment. Continuous ledge 54 has a generally rectangular picture-frame-like shape and extends fully around access opening 17 which is thereby formed by sides 24, 26, head 28, and member 44. Ledge 54 has a top surface 56 which is substantially horizontally flat and is suitable for receiving a seal 58 which fully extends around surface 56. Ledge 54 further includes attachment holes 60 for attaching tray 18 as described below.

Tray 18 is substantially rectangular in shape and matingly fits within access opening 17 onto surface 56. The preferred embodiment includes a seal 58 which is sandwiched between surface 56 and the bottom of tray 18. Thus, cremated remains 12 can be placed within hollow portion 16 through access opening 17 and spread throughout the entire area of hollow portion 16. Tray 18 can then be placed in position within access opening 17 on seal 58 to sealingly close hollow portion 16 and thus providing proper storage for the cremated remains 12. Holes 62 are drilled in tray 18 corresponding to holes 60 and are used for attachment. In the preferred embodiment, holes 60 and 62 are located at each corner and also centrally along the sides of tray 18 and surface 56. Screws 64 extend through holes 62 and thread into holes 60 and provide secure attachment of tray 18 against surface 56 thus providing the force necessary to seal tray 18 against seal 58 and surface 56.

A cover 22 shaped to complement partial top 34 is pivotally attached to rear side 26 and is designed to pivotally close onto base 15 to form a miniature casket, and further to pivotally open for display. Cover 22 is pivotally attached by a hinge (not shown) along the top of rear side 26. Link member 66 is attached between cover 22 and end 28 and spaced a distance forward of rear side 26. Link 66 is designed to hold cover 22 in a vertically open position and prevent cover 22 from accidentally closing or over-extending rearwardly. Link 66 cooperatingly releases as cover 22 is pivoted forward to a closed position. Cover 22 folds forwardly to a closed position and sealingly engages the exposed portion 68 of base 15 to close off the area above tray 18. In the preferred embodiment, cover 22 includes a seal around its periphery to sealingly close onto base 15. The front edge 70 of cover 22 includes latches 72 which cooperate with catch or latch members 74 positioned along the upper edge of front side 24 to lockingly close cover 22 on base 15. In the preferred embodiment, latches 72 are releasable by a slideable button (not shown) which is discretely positioned along front side 24 or front edge 70.

The preferred embodiment also includes a cloth material 76 which may be of various texture such as the velvet like material shown. In the preferred embodiment, cloth material 76 covers the exposed portions of tray 18, sides 24, 26, end 28, and downwardly extending member 44, as well as the underside of cover 22. An image may be embroidered or imprinted on the cloth material used on cover 22 for added effect such as design 78.

Having described the various components of the cremation holder embodying the present invention, the use of this cremation holder should become obvious to those skilled in the art. Briefly, the use of the cremation holder is as follows. Cremation holder 10 is generally assembled with all components in place but with tray 18 removed. Cremated remains 12 are placed within holder 10 through access opening 17 and within hollow portion 16. Tray 18 is then placed on seal 58 and against surface 56 of continuous ledge 54. Screws 64 are secured into place holding tray 18 against surface 56 within holder 10. Memorabilia 14 are then placed on tray 18 as desired. Cover 22 is pivotally closed and latched by latches 72, 74 providing a fully closed miniature casket for cremated remains 12 and also for memorabilia 14.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A cremation remains holder comprising:

a holder base having the shape of a miniature casket and including a hollow portion suitable for receiving cremated remains, the hollow portion having an access opening;

a tray sized to fit within the access opening to sealingly close the hollow portion, the tray positionable in the holder base such that memorabilia can be placed thereon;

means for holding the tray securely in the holder base;

a cover shaped to sealingly close on the access opening and over the tray to retain the memorabilia in the holder base; and means for holding the cover closed on the holder base.

2. The holder defined in claim 1 wherein a part of the hollow portion of the holder base and also a part of the tray are lined with a material for aesthetics.

3. The holder defined in claim 2 wherein the material has a velvet-like feel and appearance.

4. The holder defined in claim 2 wherein a part of the cover is lined with a material for aesthetics.

5. The holder defined in claim 4 wherein a design is placed on the inside of the cover.

6. The holder defined in claim 1 wherein a design is placed on the inside of the cover.

7. The holder defined in claim 1 wherein decorative hardware is affixed to the holder base.

8. The holder defined in claim 1 wherein the holder base includes a ledge that extends around the periphery of the hollow portion, and the tray sealingly engages the ledge.

9. The holder defined in claim 8 wherein the means for holding the tray in the holder base includes fasteners which engage the holder base.

10. The holder defined in claim 1 wherein the means for holding the cover on the holder base includes hinges located on a side of the cover, a lock located on an opposite side of the cover and a catch located on the holder base corresponding to and designed to cooperatingly engage the lock on the cover.

11. The holder defined in claim 10 wherein the lock is a keyless lock which blends with the outside of the holder base when the cover is closed.

12. A cremation remains holder comprising:

a holder base having a box-like shape and including a single open hollow portion suitable for receiving cremated remains and memorabilia;

a divider for dividing the hollow portion into a first area suitable for storing the cremated remains and a second area suitable for storing memorabilia, the divider sealingly separating the first and second areas;

means for securing the divider in the holder base;

a cover shaped to close on the open hollow portion to sealingly contain cremated remains and memorabilia placed therein; and means for securing the cover to the holder base.

13. The holder defined in claim 12 wherein an exposed part of the holder base, divider, and cover are lined with a material for aesthetics.

14. The holder defined in claim 12 wherein the base is in the shape of a minature casket.

* * * * *